US008157604B2

(12) United States Patent
Kotlyar

(10) Patent No.: US 8,157,604 B2
(45) Date of Patent: Apr. 17, 2012

(54) ELECTRICAL LINEAR MOTOR FOR PROPULSION OF MARINE VESSEL

(76) Inventor: Oleg Kotlyar, W. Valley City, UT (US)

( * ) Notice: Subject to any disclaimer, the term of this patent is extended or adjusted under 35 U.S.C. 154(b) by 90 days.

(21) Appl. No.: 12/804,370

(22) Filed: Jul. 20, 2010

(65) Prior Publication Data

US 2010/0291813 A1 Nov. 18, 2010

Related U.S. Application Data

(60) Provisional application No. 61/271,683, filed on Jul. 25, 2009.

(51) Int. Cl.

| | |
|---|---|
| ***B63H 21/17*** | (2006.01) |
| ***B63H 11/06*** | (2006.01) |
| ***F04B 17/04*** | (2006.01) |
| ***H02K 33/00*** | (2006.01) |
| ***H02K 33/16*** | (2006.01) |
| ***H02K 33/18*** | (2006.01) |

(52) U.S. Cl. ..... 440/6; 440/17; 440/18; 440/38; 60/221; 417/416; 310/15

(58) Field of Classification Search ..... 440/6, 17–20, 440/38, 44, 45, 47; 114/337; 60/221, 222, 60/595, 596, 911; 417/415–419; 310/15–24, 310/36–39

See application file for complete search history.

(56) References Cited

U.S. PATENT DOCUMENTS 7,604,520 B2 10/2009 Kotlyar

FOREIGN PATENT DOCUMENTS

WO WO 0125084 A1 * 4/2001

* cited by examiner

*Primary Examiner* — Ajay Vasudeva

(57) ABSTRACT

An electrical linear motor for propelling a marine vessel through a liquid medium, comprises a housing secured to the marine vessel and submerged in the liquid medium, an insert within the housing and having at least two electrical coil windings disposed on internal walls of the insert; a thruster subassembly moves between the internal walls of the insert, the thruster subassembly having a front cover, an internal channel with check valve and at least two sets of permanent magnets attached to the thruster subassembly and maintained in sufficiently close proximity to the electrical coil windings so that an electromagnetic field created by a controlled energizing of the electrical coil windings interacts with a magnetic field from the permanent magnets to provide a resulting linear force, which causes a reciprocating linear motion of the thruster subassembly, wherein the check valve is in an open position during a back stroke of the thruster subassembly so that the liquid medium flows freely through the thruster subassembly internal channel and wherein the check valve is closed during a working stroke of the thruster subassembly so that the front cover of the thruster subassembly displaces the liquid medium, thereby propelling the marine vessel through the liquid medium.

8 Claims, 2 Drawing Sheets

ELECTRICAL LINEAR MOTOR FOR PROPULSION OF MARINE VESSEL

CROSS-REFERENCE TO RELATED APPLICATIONS

This application claims the benefit of the U.S. Provisional patent application Ser. No. 61/271,683 filed Jul. 25, 2009 and is related to U.S. Pat. No. 7,604,520 B2, filed Jul. 30, 2007, which is hereby incorporated by reference.

TECHNICAL FIELD

The present invention relates to a method and system for propelling an object through a liquid medium, such as water, using an electrical linear motor (ELM).

BACKGROUND OF INVENTION

Electrical linear motors are used in various electromechanical actuators. Electrical linear motors are used as well to propel vehicles. For example, linear motors are used in magnetic levitation technology in which train passenger cars float above a concrete guide way and in other high speed "wheels-on-rails" trains. These types of linear motors are usually of the linear synchronous design with an active winding on one side of an air-gap and array of alternate pole magnets on the other side. These magnets can be permanent magnets or energized magnets.

Electrical rotary motors are used to propel vehicles and marine vessels such as boats and submarines. Electrical rotary motors for marine vessels utilize propellers to transform the rotary motor mechanical energy into working propulsion linear force. A disadvantage of utilizing propellers to propel a marine vessel is that the propeller creates a water rotational movement (swirl) in the water, thereby making the vessel more easily detected.

Using electrical linear motors for propelling a marine vessel, submarine, torpedo, or bathyscaphe, has several advantages over electrical rotary motors. For example, electrical linear motors can produce up to 3000 lbs. of linear driving force and therefore can provide increased velocities to the vessels. Also, the acceleration rate of electrical linear motors is up to 10 g. An electrical linear motor directly transforms its electrical energy into electrical linear motor propulsion force and therefore as a vessel's drive the electrical linear motor is simple, requiring few moving parts and not requiring mechanical transmissions such as propellers. As a result, ELM propulsion systems, consisting of electrical linear motors, whose rotors or stators simultaneously work as propulsions system thrusts, are more reliable than propulsion systems with rotary motors. The operation of electrical linear motors does not create pollution to the environment and is more energy efficient than electrical rotary motors. The ELM drive can be based on direct current (DC) or alternating current (AC).

In one known marine propulsion system employing a electrical linear motor as a drive (U.S. Pat. No. 7,604,520B2), the thruster subassembly and its two ball linear bearings are disposed inside of a guide tube. The permanent magnets are attached to the thruster subassembly by means of a magnet holder and placed outside of the guide tube in close proximity to electrical coil windings, which also are positioned outside and parallel to the guide tube. In such design embodiment the result of the interaction between magnetic field of magnets and electro-magnetic field of electrical coil windings is an axial force applied to the thruster subassembly permanent magnets. Then this force transforms into the axial resulting force, having a vector coinciding with the thruster subassembly longitudinal axis, and turning torque, which tries to turn thruster subassembly in the plane of the longitudinal section of the electrical linear motor propulsion system, thereby creating a radial load on two linear bearings supporting the propulsion system thruster subassembly. That radial load creates increased friction losses and heat emissions in linear bearings thereby resulting in linear bearings and thruster subassembly contact areas more intensive wear.

An advantage of the present invention is an electrical linear motor compact design that results in a single axial propelling force, vector of which coincides with the thruster subassembly longitudinal axis, thereby excluding a radial load on linear ball bearings and therefore providing more reliable and long-lasting operational life span for the electrical linear motor marine propulsion system.

Another advantage of new invention is that the increase of the resulting axial linear propelling force can be done by increase of the amount of electrical coil windings 3 (FIG. 1) placed in the electrical linear motor insert 2, and corresponding number of permanent magnets sets 4 installed on the magnet holder 12 without any change of insert outside diameter. For that purpose the geometry of the linear motor insert 2 (FIG. 1) internal space passage—place for thruster subassembly reciprocating movement—and also thruster subassembly permanent magnets holder 12 (FIG. 1) outside geometry have to be an equilateral triangular (case for 3 sets of electrical coil windings and magnets; FIG. 3), square (case for 4 sets of electrical coil windings and magnets; FIG. 4) pentagonal (case of 5 sets of electrical coil windings and magnets; FIG. 5). The amount of windings and magnets sets depends on how big the insert maximum outside diameter can be selected for each project.

SUMMARY OF THE INVENTION

Aspects of the invention relate to employment of the new electrical linear motor propulsion system to propel an object through a medium such as water. One aspect of the invention comprises an electrical linear motor(s) within a cylindrical housing, which is secured to the vessel and submerged in the water. Two covers (one cover on each housing butt end) are connected to the housing. Each cover has a linear ball bearing, o-ring and cuff seal protecting an inner housing compartment against invasion of dirt and water from the environment. An insert within in the inner housing of the water protected compartment, has a U-shaped cross section with space passage for reciprocating movement of magnets, attached to movable linear motor rotor-thruster subassembly. Linear motor coil windings within the housing are disposed on the insert internal passage walls and are positioned parallel to the longitudinal insert axis along the insert axial length. The electrical linear motor rotor-thruster subassembly performs controllable reciprocating movement between the electrical coil windings located on the insert internal passage walls. The thruster subassembly cylindrical parts move inside of two linear bearings, which in its turn are placed into the two butt-end covers. The permanent magnets are maintained in sufficiently close proximity to the electrical coil windings by two roller restrictors so that an interaction of an electromagnetic field created by the controlled energizing of the electrical coil windings, with a magnetic field from the permanent magnets provides the reciprocal axial force and as a result of action of that force a reciprocal linear motion of the thruster subassembly within the housing. The thruster subassembly having an opposing first and second ends and a check valve installed in the thruster subassembly internal channel, the check valve being in an open position during a back stroke of the thruster subassembly, so that the water flows freely through the thruster subassembly internal channel thereby the thruster has a small water resistance during back stroke. The check valve is in a closed position during a working stroke of the thruster subassembly, so that its front part displaces water with an acting linear force created by the electrical linear motor, and the force of water resistance affects the thruster subassembly and through its magnetic fields, magnets, windings, insert and housing—is transmitted to a vessel hull, thereby propelling the vessel through the water.

Another aspect of the invention includes various techniques of attaching the new electrical linear motor housing to the vessel, thus giving the propulsion system additional degrees of freedom, thereby increasing maneuverability of the vessel.

An additional aspect of the invention includes the use of several linear motors of new design to propel a marine vessel, submarine, bathyscaph, torpedo, etc. Two or more linear motors can be attached to a vessel (i.e., rigidly attached, attached by means of a rotating shaft, or rotating coupling hinged attachment). The numerous linear motors are preferably mounted on opposing sides of the vessel's longitudinal axis, with the longitudinal axis each linear motor being parallel to the longitudinal axis of the vessel. Turning a vessel can be accomplished by controlling the propelling force generated by each of the several electrical linear motors.

DETAILED DESCRIPTION OF THE PREFERRED EMBODIMENTS

Figure 1:
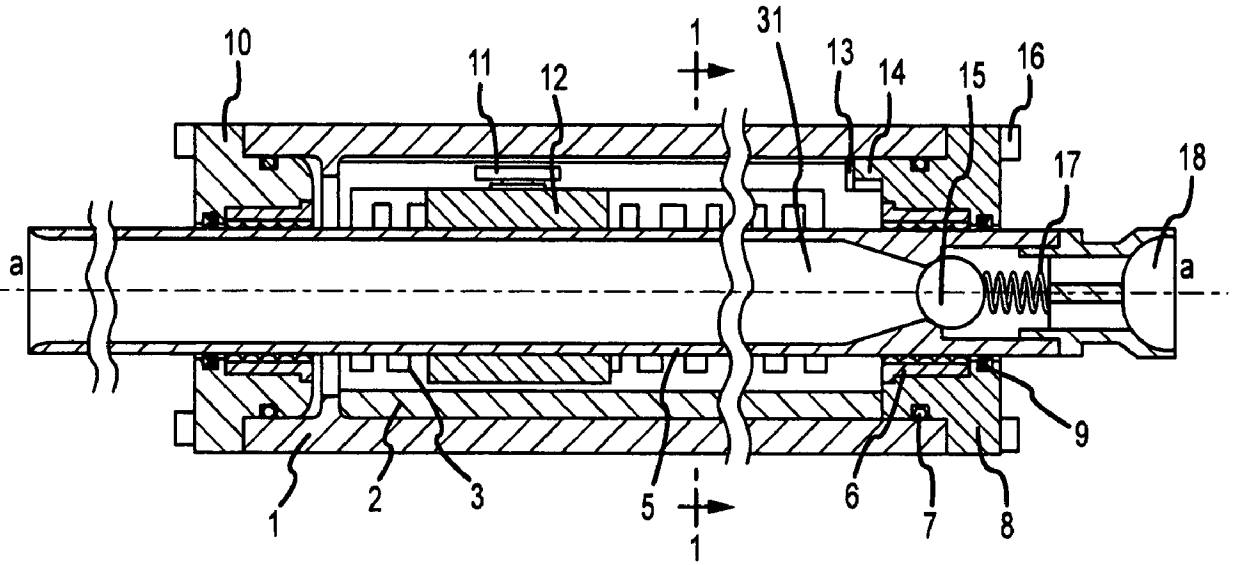
FIG. 1 is a cross sectional side view of the electrical linear motor for propelling a marine vessel.

Referring to FIG. 1 there is disclosed an embodiment of an electrical linear motor with a linear motor cylindrical housing 1. The electrical linear motor housing 1 is submerged in the medium through which an object, such as a vessel, is to be propelled on the water surface or the object could be a submarine or bathyscaphe completely submerged underwater. For purposes of this application, the term "medium will generally hereinafter be referred to as water, it being acknowledged that medium could consist of any liquid material.

The electrical linear motor housing contains an insert 2 that has a U-shaped cross-section. At least, two electrical windings 3 are disposed on internal vertical walls of the insert 2—one opposite another, but with a space between them. Two sets of magnets 4 are attached to a magnet holder 12 that is secured to the body of a thruster subassembly 5. Thruster subassembly 5 with an internal channel 31, has a longitudinal axis coinciding with the longitudinal axis of the housing 1. The thruster subassembly with sets of magnets is capable of performing reciprocal motion in that space passage between windings 3, attached to the insert 2, along the housing 1 longitudinal axis. That motion is caused by a controllable interaction between the electromagnetic field created by energizing electrical linear motor windings and the magnetic field created by the electrical linear motor permanent magnets. By controlling the electrical current flowing through the coil windings 3—which are attached to the insert 2—change of the speed and linear direction of the thruster subassembly 5 can be achieved.

A change of the thruster subassembly 5 direction of its movement inside of the insert 2 space passage can be achieved for example: (a) for DC electrical linear motor—by controllable winding(s) 3 current direction change; and (b) for AC electrical linear motors—by controllable stator winding(s) 3 magnetic flow direction change.

Additionally, a change of the thruster subassembly 5 speed during its motion inside of the insert 2 can be achieved by coil winding(s) current frequency change. This method of thruster subassembly speed regulation can be used for AC electrical linear motors. For DC linear motors, the speed of the reciprocating thruster subassembly can be in creased or decreased by change of the value of the current in the winding(s) 3.

The thruster subassembly 5 performs its reciprocating linear motion in the two linear ball bearings 6 placed in two butt-end covers 8 and 10, and each of them have O-ring 7 and cuff seal 9 completely protecting the housing 1 internal compartment with windings, magnets and linear bearings against invasion of environment, dirt and water. Both butt-end covers 8 and 10 are connected with the housing 1 by bolts 16.

The thruster subassembly 5 includes a check valve 15 and its spring 17 and front cover 18, the check valve 15 is in a closed position during a thruster subassembly 5 working stroke so that the front part of the thruster subassembly 5 interacts with adjacent layers of water with its full front cross section. As a result, two forces are present at the area of contact. The first one is applied to water and tries to displace the water. The second force is a force of reaction, which is applied to the front cover 18 of the thruster body 5. That force is transmitted through the thruster subassembly body 5, magnets 4 and its magnetic field to the non-moving winding(s) 3 and its electromagnetic magnetic field, then to the insert 2 and linear motor housing 1 and then to the vessel's hull, thereby stipulating the movement of the vessel. The electrical linear motor propels the vessel as if pushing itself off the water. During the back stroke, the check valve 15 is in an open position that provides a free passage for water flow going through the thruster subassembly internal channel and check valve and therefore allows a fast thruster subassembly back stroke. A continuous repetition of the working stroke/back stroke process provides continuous propulsion of the vessel through the media.

The geometry of the thruster subassembly front cover has to provide a maximum water resistance to the thruster subassembly during the electrical linear motor working stroke, because a force of water resistance to the thruster subassembly during the working stroke is the propelling force for vessels, submarines etc. employing electrical linear motor propulsion systems.

In order to preclude the insert 2 from turning around its longitudinal axis, the insert 2 right butt-end has a slot 13 and a special "tooth" 14 as a part of the adjacent cover 8 comes into the slot 13 locking the insert 2 into place.

In order to exclude physical contact between the winding (s) 3 and the magnets 4 and as well to maintain the permanent magnets 4 in close and needed proximity to the electrical coils winding(s) 3, the thruster subassembly 5 has two roller restrictors 11, attached to the magnet holder 12. Each roller is in contact with just one side of the insert 2 internal passage during working and back strokes of the thruster subassembly 5. Each roller restrictor sits on a small vertical shaft, which is fixed to a metal plate. The plate is bolted to the holder of the magnets 4 with two bolts that go all the way through two slots in the plate. The configuration of the slots allows for specific adjustment to roller position. The rollers are made of non-corrosive material.

Figure 2:
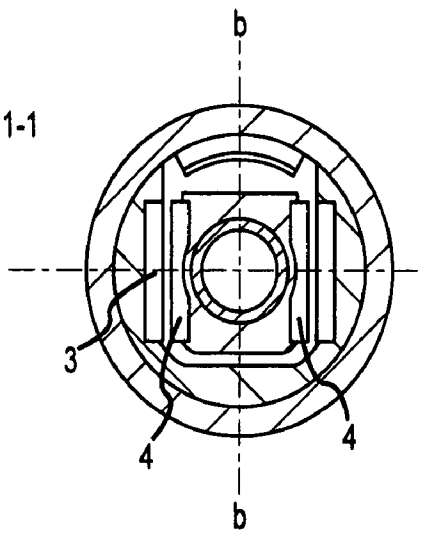
FIG. 2 is a cross sectional view of the electrical linear motor taken through lines 1-1 of FIG. 1

The electrical linear motor propulsion system of the present invention can be attached to the vessel or submarine hull in a number of different manners. For example, the electrical linear motor housing can be rigidly attached to the vessel, thereby providing the propulsion system with one degree of freedom—the thruster subassembly with magnets moves only along the longitudinal axis of the thruster housing. Alternatively, the housing of the linear motor can be attached to the vessel by means of a 360° rotating shaft. Such configuration provides the propulsion system with two degrees of freedom—the movable thruster subassembly moves linearly along the longitudinal axis of the linear motor housing and the linear motor also can be rotated by means that rotating shaft within 360° around axis b-b (FIG. 2). Due to these two movements the propulsion linear force vector can be directed in any direction within 360° in vertical or horizontal planes. Additionally the linear motor housing can be attached to the vessel by using a 360° rotating shaft and a coupling hinge between the rotating vessel shaft and the electrical linear motor housing. This provides the propulsion system with three degrees of freedom and results in a highly maneuverable vessel moving through the water surface and submarine, bathyscaphes, moving under water.

The electrical linear motor propulsion system may consist of two or more electrical linear motors and located on opposite sides of the vessel, submarine, bathyscaphe, torpedo longitudinal axis. The longitudinal axes of the electrical linear motors are parallel to the longitudinal axis of the vessel. To turn the vessel, one electrical linear motor operates at a higher velocity than the other electrical linear motor thereby resulting in turning the vessel to the side of the lower velocity electrical linear motor.

There are two advantages of using several linear motors (two or more) as the marine vessels drive: 1) a greater linear propulsion force is generated when two or more electrical linear motors work together synchronously, and 2) a constantly acting propelling force is generated when two or more electrical linear motors work consecutively with an overlapping of their thruster subassembly working strokes.

Figure 5:
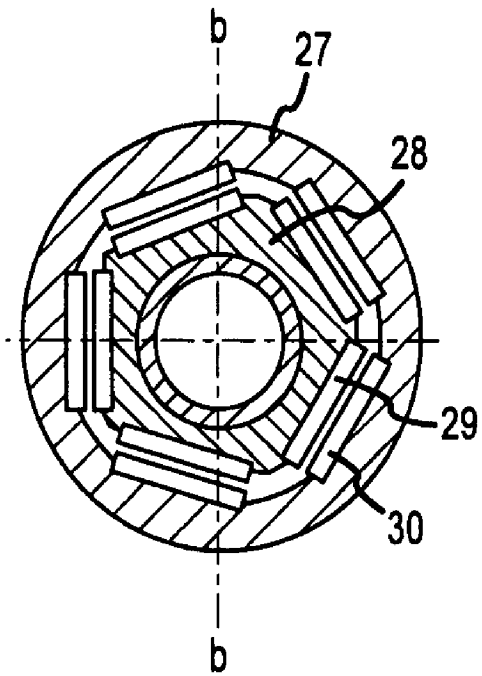
FIG. 5 is a cross sectional view of the electrical linear motor insert with pentagonal apace passage for thruster subassembly movement, with five sets of windings attached to the insert and five sets of permanent magnets connected with its holder having the same pentagonal outside geometry as insert internal passage.
Figure 4:
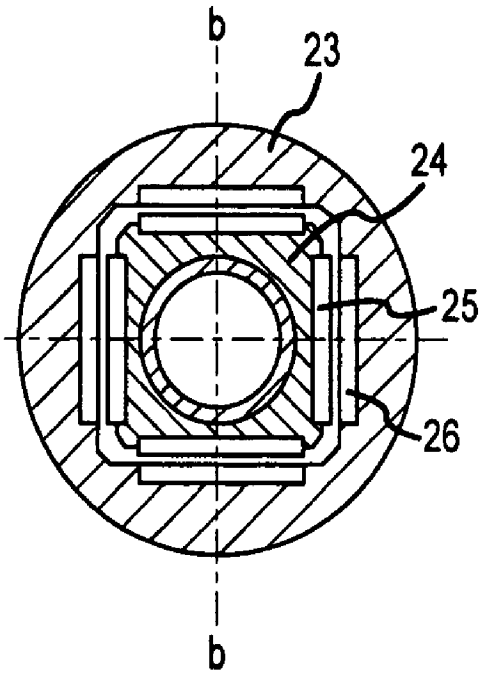
FIG. 4 is a cross sectional view of the electrical linear motor insert with square shape of the internal space passage for thruster subassembly movement, with four sets of windings attached to the insert and for sets or permanent magnets connected with its holder having the same square outside geometry as insert internal space passage.
Figure 3:
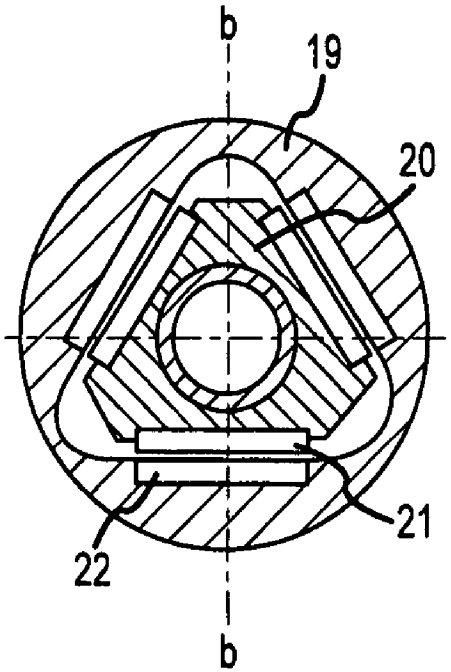
FIG. 3 is a cross sectional view of the electrical linear motor insert with equilateral triangle geometry of space passage for thruster subassembly movement, with three sets of windings attached to the insert and three sets of permanent magnets connected with its holder having the same outside geometry as insert internal passage.

In order to increase electrical linear motor acting propelling force, several (3 or more) stator electrical windings can be placed on the linear motor insert 2 and a corresponding number of magnets can be placed on the thruster assembly magnet holder 12. This is accomplished by changing both the insert 2 and magnet holder 12 geometry. Namely, the shape of internal passage of insert 2, 19, 23 and 27 (FIG. 2, FIG. 3, FIG. 4, and FIG. 5 respectively) for thruster subassembly reciprocating motion and outside configuration of the magnet holder 12, 20, 24 and 28 (FIG. 2, FIG. 3, FIG. 4 and FIG. 5 respectively) has to be as equilateral triangle (3 sets of windings 22 and magnets 21: See FIG. 3), square (4 sets of windings 26 and magnets 25: See FIG. 4), and pentagonal (5 sets of windings 30 and magnets 29: See FIG. 5) etc. Additional sets of windings and magnets can also be provided in the present invention, with corresponding changes in the insert 2 and magnet holder 12 geometries.

In compliance with the statue, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An electrical linear motor for propelling a marine vessel through a liquid medium, comprising:

a housing secured to the marine vessel and submerged in the liquid medium;

an insert within the housing, the insert having internal walls defining an internal passage through the insert and at least two electrical coil windings disposed on the internal walls;

a thruster subassembly including a magnet holder, an internal channel with check valve, and a front cover, the thruster subassembly being disposed between the internal walls of the insert, the thruster subassembly further having a longitudinal axis coinciding with a longitudinal axis of the insert;

at least two permanent magnets attached to the magnet holder of the thruster subassembly and maintained in sufficiently close proximity to the electrical coil windings so that an electromagnetic field created by a controlled energizing of the electrical coil windings interacts with a magnetic field from the permanent magnets to provide a reciprocating linear motion to the thruster subassembly;

wherein the check valve is in an open position during a back stroke of the thruster subassembly so that the liquid medium flows freely through the thruster subassembly internal channel and wherein the check valve is closed during a working stroke of the thruster subassembly so that the front cover of the thruster subassembly displaces the liquid medium and thereby propelling the marine vessel through the liquid medium.

2. The electrical linear motor of claim 1 wherein the housing is rigidly secured to the vessel.

3. The electrical linear motor of claim 1 wherein the housing is secured to the vessel by a rotatable shaft.

4. The electrical linear motor of claim 3 wherein the housing is secured to the vessel by a coupling hinge interposed between the rotatable shaft and the linear motor housing.

5. A marine propulsion system for propelling a marine vessel through a liquid medium, comprising:

a plurality of electrical linear motors, each linear motor further comprising:

a housing secured to the marine vessel and submerged in the liquid medium;

an insert within the housing, the insert having internal walls defining an internal passage longitudinally through the insert and at least two electrical coil windings disposed on the internal walls;

a thruster subassembly including a magnet holder, a front cover, and an internal channel having a check valve, the thruster subassembly being disposed between the internal walls of the insert, the thruster subassembly having a longitudinal axis coinciding with a longitudinal axis of the insert;

at least two sets of permanent magnets attached to the magnet holder of the thruster subassembly and maintained in sufficiently close proximity to the electrical coil windings so that an electromagnetic field created by a controlled energizing of the electrical coil windings interacts with a magnetic field from the permanent magnets to provide a reciprocating linear motion to the thruster subassembly;

wherein the check valve is in an open position during a back stroke of the thruster subassembly so that the liquid medium flows freely through the thruster subassembly internal channel and wherein the check valve is closed during a working stroke of the thruster subassembly so that the front cover of the thruster subassembly displaces the liquid medium and thereby propelling the marine vessel through the liquid medium.

6. The marine propulsion system of claim 5 wherein the housing is rigidly secured to the vessel.

7. The marine propulsion system of claim 5 wherein the housing is secured to the vessel by a rotatable shaft.

8. The marine propulsion system of claim 7 wherein the housing is secured to the vessel by a coupling hinge interposed between the rotatable shaft and the housing.

* * * * *